US007128026B2

(12) United States Patent
Braun et al.

(10) Patent No.: US 7,128,026 B2
(45) Date of Patent: Oct. 31, 2006

(54) METHOD FOR CONTROLLING THE HEAT IN AN AUTOMOTIVE INTERNAL COMBUSTION ENGINE

(75) Inventors: Marco Braun, Renningen (DE); Christoph Burckhardt, Stuttgart (DE); Michael Haas, Stuttgart (DE); Roland Lütze, Leonberg (DE); Alexander Müller, Leinfelden-Echterdingen (DE); Michael Reusch, Schwaikheim (DE); Ulrich Springer, Stuttgart (DE); Jens von Gregory, Remshalden (DE)

(73) Assignee: DaimlerChrysler AG, Stuttgart (DE)

( * ) Notice: Subject to any disclaimer, the term of this patent is extended or adjusted under 35 U.S.C. 154(b) by 60 days.

(21) Appl. No.: 10/998,355

(22) Filed: Nov. 27, 2004

(65) Prior Publication Data

US 2006/0005790 A1 Jan. 12, 2006

Related U.S. Application Data

(63) Continuation-in-part of application No. PCT/EP03/03301, filed on Mar. 29, 2003.

(30) Foreign Application Priority Data

May 31, 2002 (DE) ..... 102 24 063

(51) Int. Cl.
*F01P 7/16* (2006.01)

(52) U.S. Cl. ..... 123/41.01; 123/41.02; 123/41.05

(58) Field of Classification Search ..... 123/41.01, 123/41.02, 41.05
See application file for complete search history.

(56) References Cited

U.S. PATENT DOCUMENTS

| | | | | |
|---|---|---|---|---|
| 4,489,680 | A * | 12/1984 | Spokas et al. | 123/41.05 |
| 4,549,504 | A * | 10/1985 | Gaines et al. | 123/41.01 |
| 4,779,577 | A * | 10/1988 | Ritter et al. | 123/41.05 |
| 4,930,455 | A * | 6/1990 | Creed et al. | 123/41.1 |
| 5,390,632 | A * | 2/1995 | Ikebe et al. | 123/41.02 |
| 5,482,010 | A | 1/1996 | Lemberger et al. | |

(Continued)

FOREIGN PATENT DOCUMENTS

| | | |
|---|---|---|
| DE | 30 24 209 | 1/1981 |
| DE | 38 10 174 | 9/1996 |

(Continued)

*Primary Examiner*—Stephen K. Cronin
*Assistant Examiner*—Jason Benton
(74) *Attorney, Agent, or Firm*—Klaus J. Bach

(57) ABSTRACT

In a method for controlling the heat in an internal combustion engine for a vehicle with a coolant circuit and actuable devices for influencing the heat balance of the internal combustion engine, wherein a coolant temperature and further operating parameters of the internal combustion engine are recorded, the actuable devices are operated as a function of the coolant temperature and the further operating parameters of the internal combustion engine in such a manner that an output value for determining a control variable is provided by means of a basic characteristic diagram as a function of the rotational speed and the load on the internal combustion engine, and this control value is corrected by means of a controller as a function of the coolant temperature and/or the further operating parameters.

9 Claims, 4 Drawing Sheets

U.S. PATENT DOCUMENTS

| | | | | |
|---|---|---|---|---|
| 5,529,025 | A * | 6/1996 | Ranzinger et al. | 123/41.1 |
| 5,617,816 | A | 4/1997 | Saur et al. | |
| 6,223,700 | B1 * | 5/2001 | Sano et al. | 123/41.1 |
| 6,308,664 | B1 * | 10/2001 | Ambros | 123/41.12 |
| 6,352,055 | B1 | 3/2002 | Algrain et al. | |
| 6,894,883 | B1 * | 5/2005 | Buchholz | 361/103 |
| 2003/0089319 | A1 * | 5/2003 | Duvinage et al. | 123/41.02 |
| 2004/0134648 | A1 * | 7/2004 | Baba et al. | 165/271 |
| 2004/0255876 | A1 * | 12/2004 | Hirooka | 123/41.05 |

FOREIGN PATENT DOCUMENTS

| | | |
|---|---|---|
| DE | 197 28 351 | 1/1999 |
| DE | 195 08 104 | 5/2000 |
| DE | 199 51 362 | 5/2001 |
| DE | 100 56 155 | 6/2001 |
| DE | 101 05 666 | 9/2001 |
| DE | 100 16 405 | 10/2001 |

* cited by examiner

| Control stage<br>Heating strategy | Stage 1<br>Heating<br>Warming-up | Stage 2<br>Heating<br>Warming-up | Stage 3<br>Heating<br>at operating temperature | Stage 4<br>Heating<br>at operating temperature | Stage 5<br>Standard operation<br>without air conditioning | Stage 6<br>Standard operation<br>with air conditioning | Stage 7<br>Cooling power<br>with air conditioning |
|---|---|---|---|---|---|---|---|
| Ambient temperature | - 20 °C | - 20 °C | - 20 °C | - 20 °C | 20 °C | 20 ... 30 °C | 30/35 °C |
| Web-material temperature | - 20 ... 120 °C | 120 ... 160 °C | 140 ... 180 °C | 160 ... 200 °C | 160 ... 200 °C | 160 ... 200 °C | 160 ... 200 °C |
| Cooling water outlet | - 20 ... 80 °C | 80 ... 90 °C | 90 ... 95 °C | 95 ... 100 °C | 100 ... 115 °C | 100 ... 115 °C | |
| Charge air downstream of CAC | < 60 °C | < 60 °C | < 60 °C | > 60 °C | > 60 °C | > 60 °C | > 60 °C |
| Air-conditioning pressure | < 12 bar | < 12 bar | < 12 bar | < 12 bar | < 12 bar | 12 ... 20 bar | |
| Exhaust-gas recirculation cooler<br>1.) Heating pump<br>Heating heat exchanger | controls | on (100 %) | on (100 %) | on (100 %) | off | off | off |
| 2.) Heat pump - engine<br>Magnet coupling | decoupled (energized) | on/off | switched on (unenergized) | switched on (unenergized) | switched on (unenergized) | switched on (unenergized) | switched on (unenergized) |
| 3.) Mixing valve<br>- Short circuit | fully open | fully open | controls | closed | closed | closed | closed |
| 3.) Mixing valve<br>- Radiator | closed | closed | | fully open | fully open | fully open | fully open |
| 4.) Shutter<br>- Charge-air cooler<br>- Condenser<br>- Water cooler | closed | closed | closed | controls | fully open | fully open | fully open |
| 5.) Electric fan | off | off | off | off | controls | max. power | max. power |
| 6.) Air-conditioning compressor | off | off | off | off | off | controls | reduced power |
| 7.) Boiling prevention means | off | off | off | off | off | off | reduced power |

Fig. 4

METHOD FOR CONTROLLING THE HEAT IN AN AUTOMOTIVE INTERNAL COMBUSTION ENGINE

This is a Continuation-In-Part Application of International Application PCT/EP03/03301 filed Mar. 29, 2003 and claiming the priority of German application 102 24 063.9 filed May 31, 2002.

BACKGROUND OF THE INVENTION

The invention relates to a method for controlling the heat in an internal combustion engine for motor vehicles with a coolant circuit and actuable devices for influencing the heat balance of the internal combustion engine, wherein a coolant temperature and further operating parameters of the internal combustion engine are recorded and the actuable devices are actuated as a function of the coolant temperature and the further operating parameters of the internal combustion engine.

German laid-open specification DE 197 28 351 A1 discloses a method for controlling the heat in an internal combustion engine for vehicles, in which, in respect of a coolant temperature, a web-material temperature between the exhaust valves and power characteristic variables of the internal combustion engine are taken into account. In addition to the temperature values themselves, the change in these values per unit time is also recorded. As power characteristic variable, it is proposed to take into account the quantity of fuel introduced in a combustion chamber per unit time or working cycle. With the method proposed in that document, the quantity of heat dissipated through the coolant circuit is controlled by means of an electric fan, electrically operated water pumps, an electrically actuable thermostat and an electrically actuable radiator shutter. In the starting phase of an internal combustion engine, as the temperature rises or the amount of heat produced increases, first the water pumps start to operate and are controlled, and then the thermostats, the radiator shutter and finally the fan start to operate and are controlled. If the temperature of the internal combustion engine cannot be controlled by means of the coolant circuit, the power output of the internal combustion engine can be reduced for safety reasons.

It is an object of the invention to provide a method for controlling the heat in an internal combustion engine for vehicles which can be used with only minor changes for a range of internal combustion engines with different components.

SUMMARY OF THE INVENTION

The present invention proposes a method for controlling the heat in an internal combustion engine for vehicles with a coolant circuit and actuable devices for influencing the heat balance of the internal combustion engine, wherein a coolant temperature and further operating parameters of the internal combustion engine are recorded and the actuable devices are actuated as a function of the coolant temperature and the further operating parameters of the internal combustion engine, wherein the coolant temperature and/or the further operating parameters are controlled in such a manner that at least two output values for determining a control variable for the actuable devices are determined on the basis of at least two different guide variables, the at least two output values are compared and the higher output value is designated the control variable and the actuable devices are controlled on the basis of the designated control variable.

This provides for maximum linking of the output values determined by virtue of the fact that only the higher output value is converted into the control variable. Maximum linking of this type creates an interface for widening the control structure. Additional functionalities or demands may be fed to the maximum linking without requiring changes to the rest of the control structure. By way of example, changes from an air-conditioning control unit or from engine requirements on account of cooling of the exhaust-gas recirculation or charge-air cooling, can be taken into account by determining an output value on the basis of these requirements, comparing this output value with the other output values and then taking it into account if it is greater or, respectively, more important than the other output values determined.

The problem on which the invention is based is also solved by a method for controlling the heat in an internal combustion engine for vehicles with a coolant circuit and actuable devices for influencing the heat balance of the internal combustion engine, wherein a coolant temperature and further operating parameters of the internal combustion engine are recorded and the actuable devices are actuated as a function of the coolant temperature and the further operating parameters of the internal combustion engine. In this method the coolant temperature and/or the further operating parameters are controlled in such a manner that an output value for determining a control variable is predetermined by means of a basic characteristic diagram (performance graph) as a function of the rotational speed and the load on the internal combustion engine, and this output value is corrected by a controller as a function of the coolant temperature and/or the further operating parameters.

By virtue of the control being effected by correction of a basic characteristic diagram, the control structure is suitable for various applications, since, for its adaption to different internal combustion engines, it is merely necessary to change the basic characteristic diagram or the correction controller. This allows various engines with different components to be operated using the same control structure.

In a refinement of the invention, a hysteresis characteristic curve is applied for the determination of a control variable.

A hysteresis characteristic curve of this type can be applied in connection with the controllers and the basic characteristic diagram in order to prevent uncontrolled switching, in particular in transition ranges, for example when the coolant pump is being switched on.

In a refinement of the invention, desired values for a coolant temperature and a component temperature of the internal combustion engine are determined by means of characteristic diagrams as a function of a rotational speed and a fuel injection quantity of the internal combustion engine.

It is in this way possible to predetermine the desired values for coolant temperature and component temperature as a function of a particular engine operating point.

In a further refinement of the invention, a plurality of states of the system formed by internal combustion engine and coolant circuit are defined and are each assigned to different values of the coolant temperature and/or of the further operating parameters, and the actuable devices for controlling at least the coolant temperature are at least in part operated differently under different operating conditions.

These measures make it possible to achieve a transparent control structure. Furthermore, different control characteristics can be provided in the engine operating states or actuable devices can be set to a maximum throughput or to zero throughput without any control intervention.

In a still further refinement of the invention, a change to the various states is triggered if predetermined limit values for an ambient temperature, a component temperature of the internal combustion engine, a coolant temperature, a charge-air temperature and/or a pressure of an air-conditioning compressor are exceeded or undershot. In the individual states, in order to control a coolant temperature and a component temperature of the internal combustion engine, the settings of a coolant pump, of a heating pump, of a mixing valve between a radiator circuit and a bypass circuit, of a radiator shutter, of a radiator fan, of an air-conditioning compressor and/or of an injection system of the internal combustion engine are altered.

These measures mean that in each case the current state of the heat balance of an internal combustion engine is always accurately known and it is therefore possible to react quickly to changes in the heat balance. As a result, only a low safety margin with respect to critical operating ranges of the internal combustion engine has to be maintained, with the result that optimum heat management can be achieved. In this way, good heating or air-conditioning comfort can be achieved with low consumption, wear and low levels of engine emissions.

The invention will become more readily apparent from and the following description of a preferred embodiment thereof described below in conjunction with the accompanying drawings:

BRIEF DESCRIPTION OF THE DRAWINGS

FIG. 4 illustrates the various possible states which the system comprising internal combustion engine and coolant circuit can adopt.

DETAILED DESCRIPTION OF AN EMBODIMENT OF THE INVENTION

Figure 1:
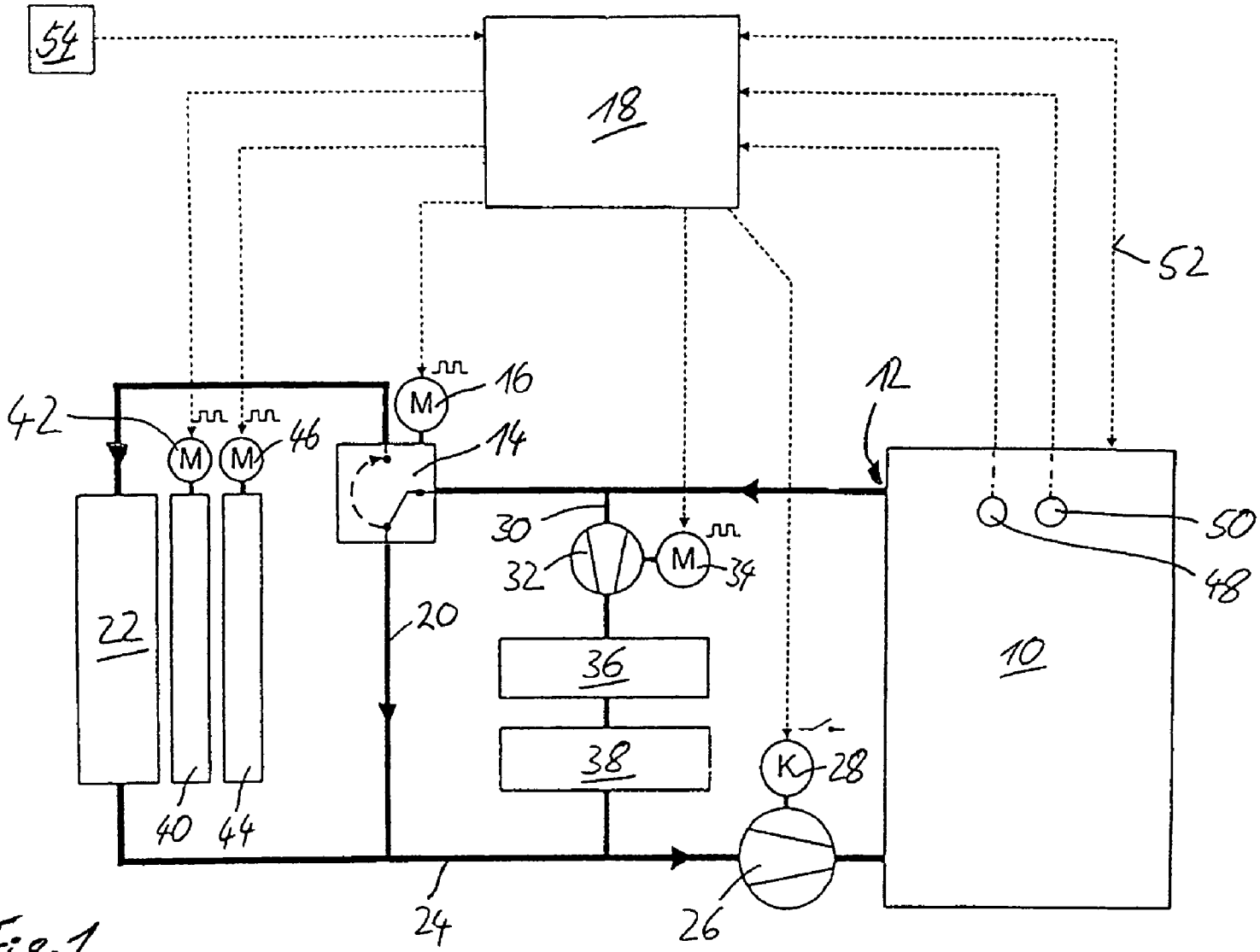
FIG. 1 diagrammatically shows an internal combustion engine for a vehicle for carrying out the method according to the invention.

The diagrammatic illustration presented in FIG. 1 shows an internal combustion engine 10 which is provided with a coolant circuit and is arranged in a motor vehicle. The method according to the invention can be carried out by means of the system diagrammatically depicted in FIG. 1 comprising the internal combustion engine 10 the and coolant circuit, as well as the further devices illustrated. A coolant circulates in the coolant circuit, the direction of flow of the coolant in the coolant circuit being indicated at various points, by arrows. Starting at an outlet opening 12 of the internal combustion engine 10, coolant passes to a controllable mixing valve 14, which is in the form of a rotary slide valve. The mixing valve 14 is adjusted by means of an electric motor 16, which is in turn actuated by a central control unit 18. In the illustration shown in FIG. 1, actuation by means of pulse width modulated signals (PWM) is indicated. The flow of coolant is directed by the valve 14 from the internal combustion engine either to a bypass line 20 or to a vehicle radiator 22. Downstream of the vehicle radiator 22, the bypass line 20 joins a main line 24, which leads to a coolant pump 26. The coolant pump 26 is driven mechanically by the internal combustion engine 10 and is provided with a magnet clutch 28 that can be actuated by the control unit 18. The coolant pump 26 can be switched on or off even when the internal combustion engine 10 is running by means of the magnetic clutch 28. As an alternative to a mechanically driven coolant pump, it is also possible to use an electrically driven coolant pump. From the coolant pump 26, the coolant returns to the internal combustion engine 10.

Upstream of the mixing valve 14, a heating circuit line 30 branches off the line connecting the coolant outlet 12 and the mixing valve 14. The heating circuit line 30 leads firstly to a heating water pump 32, which is driven by an electric motor 34. The electric motor 34 is energized by the control unit 18 by means of pulse width modulated signals. Downstream of the heating pump 32, the heating circuit line 30 leads to an exhaust-gas recirculation heat exchanger 36. A heating heat exchanger 38 is connected in series downstream of the exhaust-gas recirculation heat exchanger 36. From the heating heat exchanger 38, the heating circuit line 30 then leads to the main line 24, which leads to the coolant pump 26.

The vehicle radiator 22 is provided with a radiator shutter 40, which can be adjusted by means of an electric motor 42, and a fan 44, which is driven by means of an electric motor 46. By controlling the electric motors 42 and/or 46, it is possible for the control unit 18 to alter a setting of the radiator shutter 40 and control the rotational speed of the fan 44.

The central control unit 18 receives input signal from a coolant temperature sensor 48 and a cylinder head web-material temperature sensor 50 in the internal combustion engine 10. The coolant temperature sensor 48 senses a temperature of the coolant at the outlet 12 of the internal combustion engine 10, and the web-material temperature sensor 50 senses a temperature of a region the cylinder head of material between the exhaust valves of the internal combustion engine 10. A connection 52 illustrated by dashed lines illustrates exchange of data between the internal combustion engine 10 and the central control unit 18. By means of exchange of data via the signal lines 52, the central control unit 18 receives actual values of operating parameters of the internal combustion engine 10 and is in a position to determine control variables for the operation of the internal combustion engine 10, for example fuel injection quantity, throttle valve position, ignition timing and the like. Furthermore, the central control unit 18 receives input signals relating to heating and air-conditioning requirements from a data block 54. If, by way of example, the block 54 requires an increased air-conditioning output, the control unit 18 can on the one hand increase an engine load and on the other hand take measures to enable the increased quantity of heat which is then produced to be dissipated via the coolant circuit.

To allow the engine to be cooled as required, a control structure is implemented in the control unit 18 to allow the mixing valve 14, the coolant pump 26, the heating pump 32, the radiator shutter 40, the fan 44 and if appropriate a fuel injection system of the internal combustion engine 10 to be controlled differently as a function of the coolant temperature and further operating parameters of the internal combustion engine 10. For this purpose, a plurality of states of the system comprising internal combustion engine 10 and coolant circuit are defined, in each of which different measures are taken to control the coolant temperature and/or the cylinder head temperature.

The control structure implemented in the control unit 18 is constructed in such a way that it can be adapted with little difficulty to different internal combustion engines 10 and/or additional operating requirements. Therefore, in the example illustrated in FIG. 1, the requirements of the data block 54 relating to heating and air-conditioning requirements are additionally processed.

Figure 2:
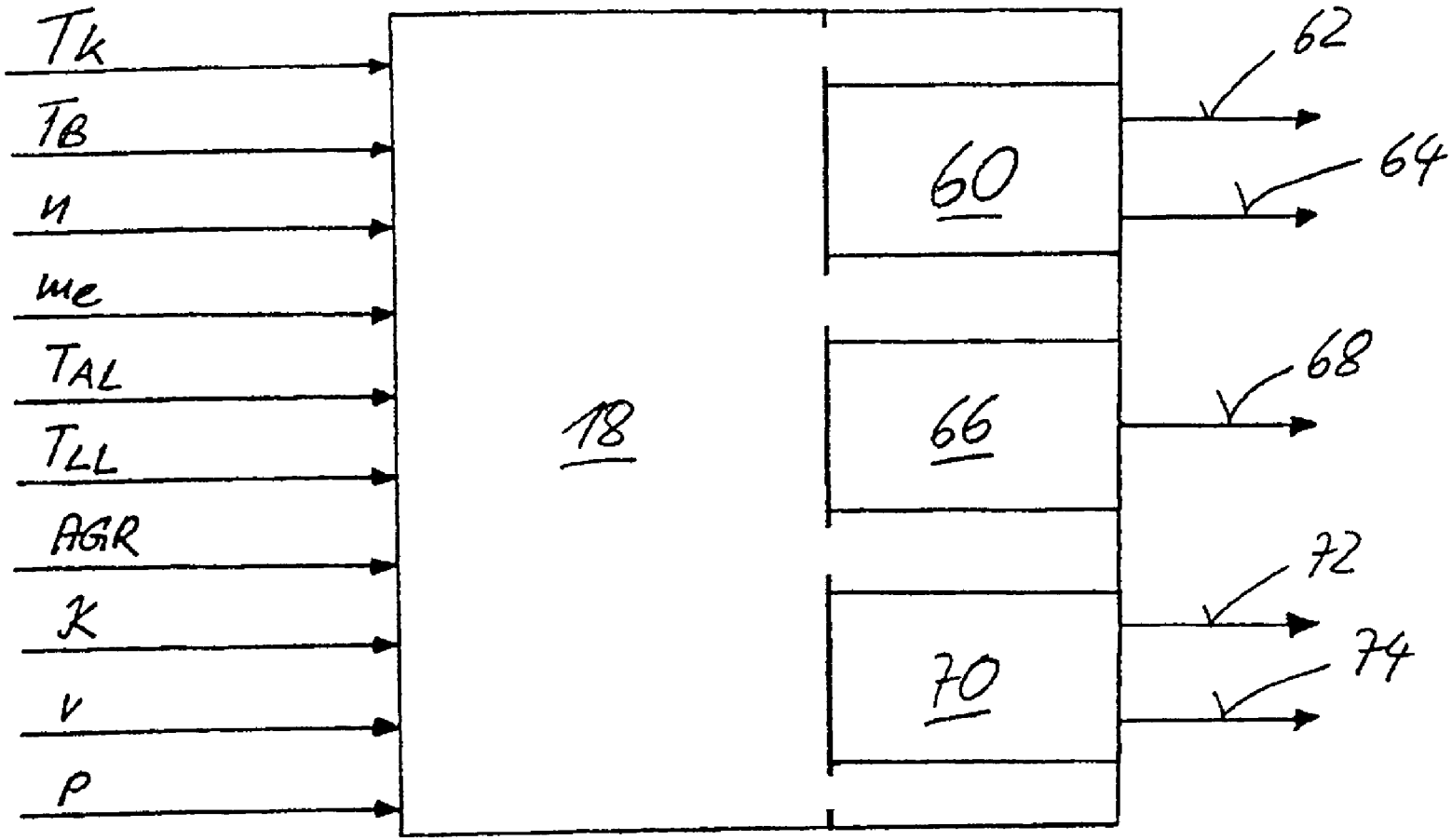
FIG. 2 illustrates the input variables and output variables of the method according to the invention.

The illustration presented in FIG. 2 diagrammatically depicts the central control unit 18. FIG. 2 is used to illustrate the input variables available to the control unit 18 and the output signals of the control unit 18 in the context of controlling the coolant and component temperature of the internal combustion engine 10. A coolant temperature $T_K$ from the coolant temperature sensor 48 and a component temperature $T_B$ from the cylinder head web temperature sensor 50 are fed to the control unit 18. Furthermore, the current engine speed n and a momentary injection quantity $m_e$ are also available to the control unit 18. The control of the coolant temperature and component temperature on the basis of these input variables $T_K$, $T_B$, n and $m_e$ is explained in detail with reference to FIG. 3.

Further input variables available to the control unit 18 include an outside air temperature $T_{AL}$, a charge-air temperature 3 $T_{LL}$, an exhaust-gas recirculation rate AGR, the abovementioned air-conditioning requirements K, a vehicle velocity v and an accelerator pedal position p. These input variables are used to determine the state of the system comprising the internal combustion engine 10 and coolant circuit, different measures being taken in the individual states to control the coolant temperature and component temperature. After the system state has been determined, a coolant volumetric flow requirement is determined, represented by block 60. The volumetric flow requirement 60 is converted into a control variable 62 for the setting of the heating circuit pump 32 and a control variable 64 for the setting of the coolant pump 26.

Furthermore, a rotary slide valve position 66 is required which is converted into a control variable 68 for the setting of the mixing valve 14.

Finally, a cooling-air mass flow requirement 70 is determined and is converted into a control variable 72 for actuating the radiator shutter 40 and a control variable 74 for actuating the fan 44.

Figure 3:
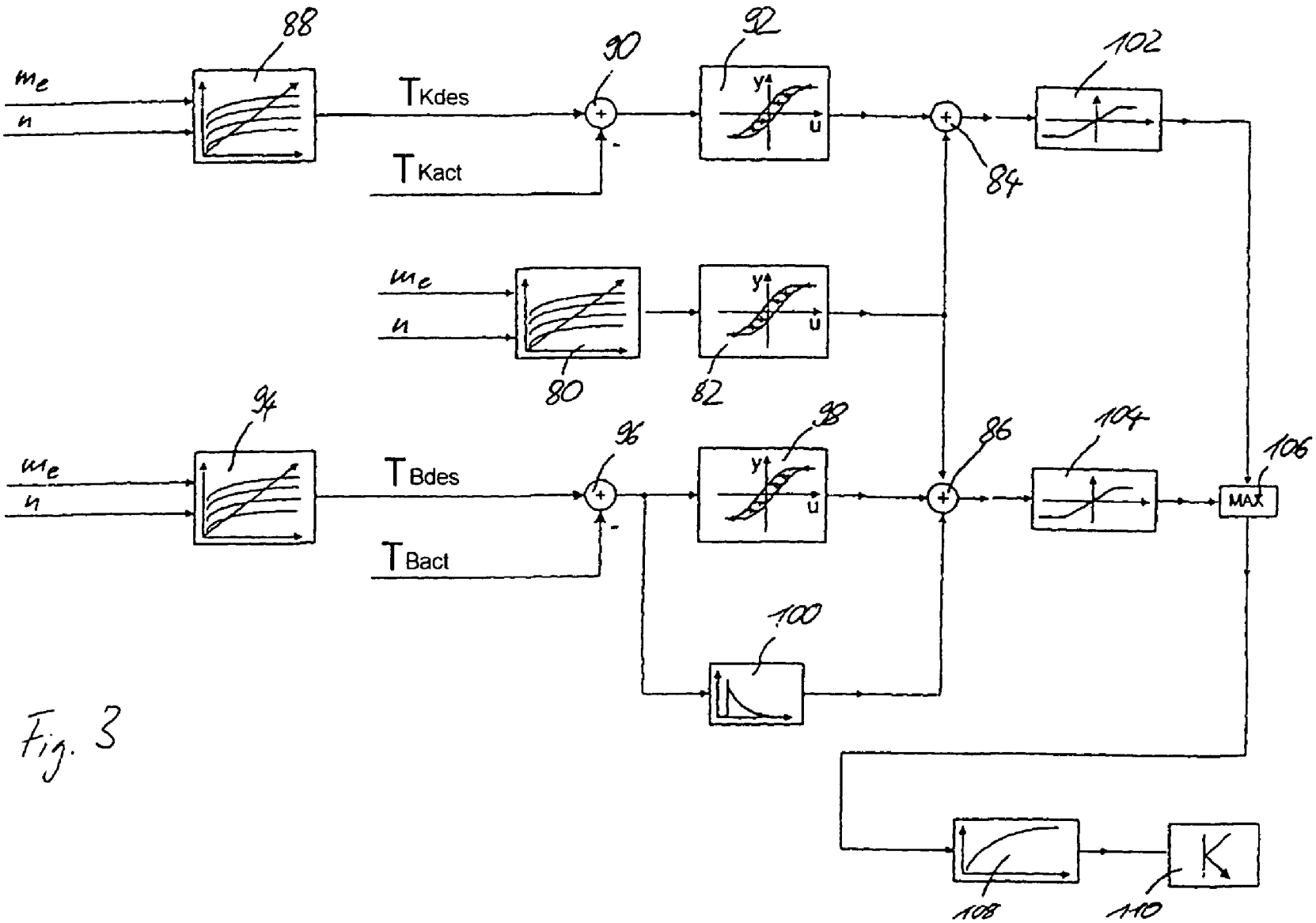
FIG. 3 shows a detailed illustration of the formation of control variables in the method according to the invention.

The illustration presented in FIG. 3 provides a more detailed illustration of the determination of the control variables in accordance with the method of the invention. The determination of a control variable is described on the basis of the controller for the coolant pump 26. By means of a basic characteristic diagram 80, a basic value for a required volumetric flow of the coolant is determined on the basis of the input variables injection quantity $m_e$ and engine speed n. This basic value from block 80 is transmitted to a block 82, in which a hysteresis characteristic curve is applied to this basic value in order to prevent uncontrolled switching in transition ranges. Therefore, a volumetric flow requirement is available at the output of the block 82 and is transmitted to the linking units 84 and 86. The basic value determined for the volumetric flow is corrected by means of the linking units. In linking unit 84, the basic value is corrected by means of a controller which uses the coolant temperature $T_K$ as guide variable, and the linking unit 86 corrects the basic value by means of a controller which uses the component temperature $T_B$ as guide variable.

To determine the correction value, a block 88 predetermines a desired value $T_{Kdes}$ for the coolant temperature as a function of the current injection quantity $m_e$ of the current engine speed n. The desired value $T_{Kdes}$ is transmitted to a linking unit 90, which also receives the current actual value of the coolant temperature $T_{Kact}$ from the coolant sensor 48 and which determines a control difference from these values. The control difference determined in this way is transmitted to a block 92, in which a hysteresis characteristic curve is applied to the control difference determined. Therefore, block 92 transmits a correction value for the volumetric flow requirement to the linking unit 84, where it adds this value to the previously determined basic value.

In a similar way, to take account of the component temperature $T_B$ in a block 94 on the basis of a basic characteristic diagram taking account of the injection quantity $m_e$ and the engine speed n, first of all a desired value $T_{Bdes}$ is determined, and a control difference is determined in a linking unit 96 from an actual value $T_{Bact}$ and the desired value $T_{Bdes}$. A hysteresis characteristic curve is applied to the determined control difference in block 98, so that block 98 transmits a correction value for a volumetric flow requirement to the linking unit 86. In parallel with the application of the hysteresis characteristic curve in block 98, block 100 takes into account a change in the component temperature over the course of time, in order to achieve satisfactory control of the component temperature, which is more dynamic than the coolant temperature. The volumetric flow requirement output by the block 100 is also fed to the linking unit 86.

Both the volumetric flow requirement from the block 84 and the volumetric flow requirement from the block 86 are checked in a block 102 or 104, respectively, to determine whether they have exceeded a maximum or minimum applicable value and if appropriate restricted to these values.

The blocks 102 and 104 then transmit the volumetric flow requirements to a maximum linking unit 106. The maximum linking unit 106 checks which of the volumetric flow requirements from block 102 or block 104 is higher and only transmits the higher volumetric flow requirement to a block 108, in which a conversion characteristic curve is applied to the volumetric flow requirement. As a result, the volumetric flow requirement is converted into an actuation signal for the coolant pump 26, which is finally amplified by means of a final stage 110 and transmitted to the coolant pump 26.

The control structure shown in FIG. 3 is easy to modify in order to adapt the control to different internal combustion engines and/or different additional devices and requirements. For example, to match it to different internal combustion engines, it is possible, for example, to alter the basic characteristic diagram 80. This would allow fundamentally different volumetric flow requirements to be achieved even without modifying the controllers which take account of the coolant temperature $T_K$ and the component temperature $T_B$. The control structure which is illustrated in FIG. 3 and can be used in the same way to determine control variables for the actuation of mixing valve 14, the radiator shutter 40, the fan 44, the heating circuit pump 32 and if appropriate the injection system of the internal combustion engine 10, can therefore easily be adapted to different engines.

Furthermore, additional requirements can also be integrated by means of the control structure illustrated in FIG. 3. For this purpose, the maximum linking unit 106 creates an interface into which further requirements can be fed. The maximum linking 106 means that access to act on the actuators of the coolant pump 26, of the heating circuit pump 32, of the mixing valve 14, of the fan 44 or of the radiator shutter 40 is in each case granted to the controller which transmits the highest requirement value to the maximum linking unit 106. Further requirements, for example from an air-conditioning control unit or from cooling of the exhaust-gas recirculation required at a specific operating point, can therefore be fed into the maximum linking unit 106, thereby ensuring that these requirements are taken into account when determining the control variables.

As has already been explained in connection with FIG. 2, the central control unit 18 uses the input variables available to it to determine which predetermined state the system comprising internal combustion engine 10 and coolant circuit should adopt at any particular time. In the preferred embodiment of the invention, seven states which the system comprising internal combustion engine 10 and coolant circuit can adopt and in each of which different measures are provided are predefined in order to control the coolant temperature and the web cylinder head temperature.

These seven possible states or stages in the heat management control of the invention are described below with reference to FIG. 4. In the overview shown in FIG. 4, each of the columns shows the conditions for a specific state or a specific stage to be adopted, as well as the measures which are taken in the corresponding state.

A first state corresponds to an engine startup, in which a component temperature is in the range from −20° C. to 120° C. and a coolant temperature at the outlet from the internal combustion engine is in the range from −20° C. to 80° C. A temperature of the charge air downstream of a charge-air cooler is lower than 60° C., and a pressure of a refrigerant in an air-conditioning circuit is below 12 bar. By way of example, ambient temperatures are low, in the region of −20° C. In this fast state, the objective is to accelerate the warming-up of the internal combustion engine 10 and to reach an acceptable interior temperature as quickly as possible. For this purpose, the volumetric flow flowing through the heating pump 32 is controlled by means of the engine 34 via the central control unit 18. As a result, this volumetric flow passes through both the exhaust-gas recirculation heat exchanger 36 and the heating heat exchanger 38, so that rapid heating of the interior can be expected. The magnet coupling 28 of the coolant pump 26 is decoupled, so that there is only passive flow through the coolant pump 26, without this flow itself contributing to any delivery of a volumetric flow. In the first state, the mixing valve 14 is set in such a way that the bypass line 20 is fully open and the line leading to the radiator 22 is fully closed. The radiator shutter 40 is fully closed, the fan 44 is switched off and an air-conditioning compressor is also switched off. What is known as a boiling prevention means, the application of which reduces the power of the internal combustion engine in order to reduce the quantity of heat produced, is switched off.

In a second state, which, like the first state, is provided for the warming-up of the internal combustion engine and in which the interior is to be heated, the cooling water and the cylinder head web between the exhaust valves has already been heated. Specifically, the state of the system is assigned to the second state by the control unit 18 if low ambient temperatures, for example −20° C., a web-material temperature in the range from 120° C. to 160° C., a temperature at the cooling water outlet 12 in the range from 80° C. to 90° C., a charge-air temperature downstream of the charge-air cooler of less than 60° C. and a refrigerant pressure of less than 12 bar are present. In this second state, to heat up the interior as quickly as possible, the heating pump 32 is switched on and is delivering 100% of the possible volumetric flow. This results in maximum flow through the exhaust-gas recirculation cooler 36 and the heating heat exchanger 38. The coolant pump 26 is switched on or off by optionally switching the magnetic clutch on or off. This takes place as a function of the coolant temperature and/or cylinder head web material temperature. In the second state, the mixing valve 14 is set in such a way that the bypass line 18 is fully open and the line leading to the radiator 22 is fully closed. The radiator shutter 44 and any further shutters upstream of the charge-air cooler and a condenser are closed. The electric fan 44, the air-conditioning compressor and the boiling prevention means are switched off.

A change to a third state occurs when the internal combustion engine is already at its operating temperature and the web-material temperature and the coolant temperature are within the desired range. Furthermore, heating in the vehicle interior is required in the third state. In detail, the system adopts the third state when low ambient temperatures, for example −20° C., a cylinder head web temperature in the range from 140° C. to 180° C., a coolant temperature at the outlet 12 in the range from 90° C. to 95° C., a charge-air temperature of less than 60° C. and a refrigerant pressure of less than 12 bar are present. In this third state, the heating pump 32 is switched on and is delivering 100% of its possible volumetric flow. The coolant pump 26 is switched on, since the magnetic clutch 28 is de-energized. The mixing valve 14 is run in control mode and consequently passes the flow of coolant through the bypass line 20 and to the radiator 22 as a function of the coolant temperature at the coolant sensor 48 and the web-material temperature at the component sensor 50. Since the mixing valve 14 is designed as a rotary slide, any distribution of the coolant to the bypass line 20 and the radiator 22 can be set in a continuously variable manner in control operation. As in states one and two, the radiator shutter 40 and any further shutters are closed, and the fan 44, the air-conditioning compressor and a boiling prevention means are switched off.

As the internal combustion engine 10 continues to heat up, a fourth state is adopted, in which the operating temperatures are already at the upper edge of the desired range. In this fourth state too, the vehicle interior has to be heated on account of low ambient temperatures. In detail, the fourth state is characterized by a web-material temperature in the range from 160° to 200° C., a coolant temperature from 95° C. to 100° C., a charge-air temperature downstream of the charge-air cooler of more than 60° C. and a refrigerant pressure of less than 12 bar. In this fourth state, the heating pump 32 is switched on and is delivering 100% of its possible volumetric flow. Since the magnet coupling 28 is de-energized, the coolant pump 26 is switched on. The mixing valve 14 adopts a limit position, completely closes the bypass line 20 and passes all of the coolant flow to the vehicle radiator 22. The radiator shutter 40 and any further shutters are controlled as a function of the coolant temperature and the web-material temperature. The fan 44, the air-conditioning compressor and the boiling prevention means are switched off.

The system changes to a fifth state when higher ambient temperatures, for example around 20° C., are present, so that heating is no longer required in the vehicle interior but air-conditioning is also not yet required. The fifth state is characterized in detail by web-material temperatures in the range from 160° C. to 200° C., coolant temperatures between 100° C. and 115° C., charge-air temperatures of more than 60° C. and a refrigerant pressure of less than 12 bar. In the fifth state, the heating pump 32 is switched off, the coolant pump 26 is switched on and the mixing valve 14 closes the bypass line 18 and passes all of the coolant flow to the radiator 22. The radiator shutter 40 and any further shutters upstream of the charge-air cooler and the condenser are fully open. The fan 44 is controlled as a function of the coolant temperature and the web-material temperature. The air-conditioning compressor and the boiling prevention means are switched off.

In the event of a further rise in the ambient temperatures, air-conditioning of the interior becomes necessary and the system changes to a sixth state. In detail, the sixth state is characterized by ambient temperatures in the range from 20° C. to 30° C., web-material temperatures in the range from 160° C. to 200° C., coolant temperatures in the range from 100° C. to 115° C., charge-air temperatures of more than 60° C. and a refrigerant pressure in the range from 12 bar to 20 bar. In this state, the system still attempts to satisfy all the requirements with respect to engine power and air-conditioning power and mobilizes all its reserves available for dissipation of heat from the internal combustion engine 10. The heating pump 32 is switched off, whereas the coolant pump 26 is switched on. The mixing valve 14 continues to keep the bypass line 18 closed and passes all of the flow of coolant to the radiator 22. The radiator shutter 40 and any further shutters are fully open. The fan 44 is running at maximum power, thereby allowing a maximum throughput of air through the radiator 22. The air-conditioning compressor is controlled as a function of the desired interior temperature. The boiling prevention means is switched off.

In the event of a further rise in the ambient temperatures and/or unfavorable boundary conditions, such as high engine power and low driving speed, it is possible for the operating temperatures of the engine to rise further, into the critical range. Therefore, in this seventh state, measures have to be taken to protect the internal combustion engine 10 from thermal damage. In detail, the seventh state is characterized by a high ambient temperature, for example between 30° C. and 35° C., a cylinder head web temperature in the range from 160° C. to 200° C., a coolant temperature in the critical range of more than 115° C., a charge-air temperature of more than 60° C. and a refrigerant pressure of more than 20 bar. All the reserves for dissipation of heat are mobilized and the heating pump 32 is switched off, the coolant pump 26 is switched on, the mixing valve completely closes the bypass line 20 and passes the entire flow of coolant to the radiator 22, the radiator shutter 40 and any further shutters are fully open and the fan 44 is running at its maximum power. To prevent a further temperature rise, the air-conditioning compressor is run with reduced power, and at the same time a reduced engine power is set by means of the boiling prevention means. This can be achieved, for example, by reducing a fuel injection quantity. If the operating temperatures drop, the system can move back to the sixth state so that the full engine and air-conditioning power is available once again.

If not all the boundary conditions for a specific stage or a specific state are satisfied, it is possible to prioritize in such a way that the system adopts a specific state when selected operating parameters are within a range defined for this state.

What is claimed is:

1. A method for controlling the heat in an internal combustion engine of a motor vehicle with a coolant circuit and actuable devices (14, 26, 32, 40, 44) for influencing the heat balance of the internal combustion engine (10), comprising the steps of recording a coolant temperature and further operating parameters of the internal combustion engine (10) and actuating the actuable devices (14, 26, 32, 40, 44) as a function of the coolant temperature and the further operating parameters of the internal combustion engine (10), in such a manner that an output value for determining a control variable is provided by means of a basic characteristic diagram (80) as a function of the rotational speed and the load on the internal combustion engine, and this output value is corrected by means of a controller as a function of at least one of the coolant temperature and the further operating parameters, wherein the at least one of the coolant temperature and the further operating parameters is controlled in such a manner that at least two output values for determining a control variable for the actuable devices (14, 26, 32, 40, 44) are determined on the basis of at least two different guide variables ($T_K$, $T_B$), the at least two output values are compared and the higher output value is converted into the control variable and transmitted to the actuable devices (14, 26, 32, 40, 44).

2. A method for controlling the heat in an internal combustion engine of a motor vehicle with a coolant circuit and actuable devices (14, 26, 32, 40, 44) for influencing the heat balance of the internal combustion engine (10), comprising the steps of recording a coolant temperature and further operating parameters of the internal combustion engine (10) and actuating the actuable devices (14, 26, 32, 40, 44) as a function of the coolant temperature and the further operating parameters of the internal combustion engine (10), in such a manner that an output value for determining a control variable is provided by means of a basic characteristic diagram (80) as a function of the rotational speed and the load on the internal combustion engine, and this output value is corrected by means of a controller as a function of at least one of the coolant temperature and the further operating parameters, wherein a hysteresis characteristic curve (82, 92, 98) is applied for the determination of a control variable.

3. A method for controlling the heat in an internal combustion engine of a motor vehicle with a coolant circuit and actuable devices (14, 26, 32, 40, 44) for influencing the heat balance of the internal combustion engine (10), comprising the steps of recording a coolant temperature and further operating parameters of the internal combustion engine (10) and actuating the actuable devices (14, 26, 32, 40, 44) as a function of the coolant temperature and the further operating parameters of the internal combustion engine (10), in such a manner that an output value for determining a control variable is provided by means of a basic characteristic diagram (80) as a function of the rotational speed and the load on the internal combustion engine, and this output value is corrected by means of a controller as a function of at least one of the coolant temperature and the further operating parameters, wherein desired values for a coolant temperature ($T_{Kdes}$) and a component temperature ($T_{Bdes}$) of the internal combustion engine (10) are determined by means of characteristic diagrams (88, 94) as a function of a rotational speed and a fuel injection quantity of the internal combustion engine (10).

4. The method as claimed in claim 1, wherein a plurality of states of the system formed by the internal combustion engine (10) and the coolant circuit are defined and are each assigned different values of at least one of the coolant temperature and of the further operating parameters, and the actuable devices (14, 26, 32, 40, 44) for controlling at least the coolant temperature are at least in part actuated differently in different states.

5. The method as claimed in claim 4, wherein a change to the different states is triggered by predetermined limit values for at least one of an ambient temperature, a component temperature of the internal combustion engine, a coolant temperature, a charge-air temperature and a pressure of an air-conditioning compressor being exceeded or undershot, and in the various states, the settings of at least one of a coolant pump (26), of a heating pump (32), of a mixing valve (14) between a radiator circuit and a bypass circuit, of a radiator shutter (40), of a radiator fan (44), of an air-conditioning compressor and of an injection system of the internal combustion engine (10) are altered to control a coolant temperature and a component temperature of the internal combustion engine (10).

6. The method as claimed in claim 2, wherein a plurality of states of the system formed by the internal combustion engine (10) and the coolant circuit are defined and are each assigned different values of at least one of the coolant temperature and of the further operating parameters, and the actuable devices (14, 26, 32, 40, 44) for controlling at least the coolant temperature are at least in part actuated differently in different states.

7. The method as claimed in claim 3, wherein a plurality of states of the system formed by the internal combustion engine (10) and the coolant circuit are defined and are each assigned different values of at least one of the coolant temperature and of the further operating parameters, and the actuable devices (14, 26, 32, 40, 44) for controlling at least the coolant temperature are at least in part actuated differently in different states.

8. The method as claimed in claim 6, wherein a change to the different states is triggered by predetermined limit values for at least one of an ambient temperature, a component temperature of the internal combustion engine, a coolant temperature, a charge-air temperature and a pressure of an air-conditioning compressor being exceeded or undershot, and in the various states, the settings of at least one of a coolant pump (26), of a heating pump (32), of a mixing valve (14) between a radiator circuit and a bypass circuit, of a radiator shutter (40), of a radiator fan (44), of an air-conditioning compressor and of an injection system of the internal combustion engine (10) are altered to control a coolant temperature and a component temperature of the internal combustion engine (10).

9. The method as claimed in claim 7, wherein a change to the different states is triggered by predetermined limit values for at least one of an ambient temperature, a component temperature of the internal combustion engine, a coolant temperature, a charge-air temperature and a pressure of an air-conditioning compressor being exceeded or undershot, and in the various states, the settings of at least one of a coolant pump (26), of a heating pump (32), of a mixing valve (14) between a radiator circuit and a bypass circuit, of a radiator shutter (40), of a radiator fan (44), of an air-conditioning compressor and of an injection system of the internal combustion engine (10) are altered to control a coolant temperature and a component temperature of the internal combustion engine (10).

* * * * *